US009300089B2

(12) United States Patent
Hashimoto et al.

(10) Patent No.: US 9,300,089 B2
(45) Date of Patent: Mar. 29, 2016

(54) ELECTRIC CONNECTOR AND DETECTION TERMINAL INCLUDED THEREIN

(71) Applicant: DAI-ICHI SEIKO CO., LTD., Kyoto (JP)

(72) Inventors: Yoshimitsu Hashimoto, Fukuoka (JP); Takashi Morita, Fukuoka (JP); Shogo Jinnouchi, Fukuoka (JP)

(73) Assignee: DAI-ICHI SEIKO CO., LTD. (JP)

( * ) Notice: Subject to any disclaimer, the term of this patent is extended or adjusted under 35 U.S.C. 154(b) by 0 days.

(21) Appl. No.: 14/541,756

(22) Filed: Nov. 14, 2014

(65) Prior Publication Data

US 2015/0140853 A1 May 21, 2015

(30) Foreign Application Priority Data

Nov. 15, 2013 (JP) ..... 2013-237344

(51) Int. Cl.
*H01R 13/641* (2006.01)
*H01R 13/627* (2006.01)
*H01R 13/703* (2006.01)

(52) U.S. Cl.
CPC ..... *H01R 13/641* (2013.01); *H01R 13/7032* (2013.01); *H01R 13/6272* (2013.01)

(58) Field of Classification Search
CPC ..... H01R 13/641; H01R 13/6272
USPC ..... 439/489, 188
See application file for complete search history.

(56) References Cited

U.S. PATENT DOCUMENTS

| | | | | | |
|---|---|---|---|---|---|
| 5,263,872 | A * | 11/1993 | Marpoe, Jr. | H01R 13/7032 | 200/51.1 |
| 5,624,275 | A | 4/1997 | Fukuda | 439/489 | |
| 5,743,760 | A | 4/1998 | Inaba et al. | 439/489 | |
| 5,775,936 | A | 7/1998 | Tsuji | 439/489 | |
| 6,077,104 | A * | 6/2000 | Chang | H01R 13/641 | 439/188 |
| 6,126,496 | A * | 10/2000 | Shinozaki | H01R 13/7033 | 439/862 |
| 6,257,922 | B1 * | 7/2001 | Shinozaki | H01R 13/7032 | 439/188 |
| 7,404,730 | B2 * | 7/2008 | Kobayashi | H01R 13/641 | 439/354 |
| 7,458,835 | B2 * | 12/2008 | Kobayashi | H01R 13/641 | 439/188 |

FOREIGN PATENT DOCUMENTS

| | | | |
|---|---|---|---|
| JP | 08-190961 | 7/1996 | H01R 13/64 |
| JP | H0917510 | 1/1997 | H01R 13/639 |
| JP | 3264311 | 3/2002 | H01R 13/627 |

* cited by examiner

*Primary Examiner* — James Harvey
*Assistant Examiner* — Oscar C Jimenez
(74) *Attorney, Agent, or Firm* — Hayes Soloway P.C.

(57) ABSTRACT

An electric connector includes a housing to be fit into a second electric connector, a lock arm resiliently deforming when the lock arm makes contact with an engagement part of the second electric connector, and thereafter, returning back to its original position, when the electric connector and the second electric connector are coupled to each other, a first detection terminal for detecting whether the electric connector and the second electric connector are electrically connected to each other, and a unit for assisting the lock arm to return back to the original position, the lock arm, the first detection terminal, and the unit being arranged in the housing, the detection terminal including a first portion to be fixed relative to the lock arm, and a second portion to make contact with a second detection terminal of the second electric connector.

16 Claims, 16 Drawing Sheets

ELECTRIC CONNECTOR AND DETECTION TERMINAL INCLUDED THEREIN

BACKGROUND OF THE INVENTION

1. Field of the Invention

The invention relates to an electric connector, and further to a detection terminal included in the electric connector for detecting whether the electric connector is electrically connected with a second electric connector.

2. Description of the Related Art

It is important for an electric connector defined with a male connector and a female connector to ensure that male and female connectors are surely coupled to each other to transmit electric signals therethrough. In particular, if electric signals could not be transmitted through male and female connectors in an electric connector employed in a safety device, because of imperfect coupling between the male and female connectors, the safety device would be unable to operate accurately. In order to avoid such a problem, an electric connector is generally designed to include a detection terminal for detecting whether male and female connectors are electrically connected to each other.

FIG. 24 is a perspective view of the electric connector disclosed in Japanese Patent Application Publication No. H8 (1996)-190961, and FIG. 25 is a cross-sectional view of the same.

The electric connector illustrated in FIGS. 24 and 25 includes a first connector housing 1 including a contact terminal 3, and a second connector housing 2 including a pair of terminals 9 and 9'. The contact terminal 3 and the terminals 9 and 9' define a unit for detecting whether the first and second connector housing 1 and 2 are surely coupled to each other. The contact terminal 3 includes a pair of resilient pieces 3*c* facing each other, and a pair of resilient pieces 3*c'* facing each other. When the first and second connector housings 1 and 2 are coupled to each other, the resilient pieces 3*c* sandwich the terminals 9 and 9' therebetween, and similarly, the resilient pieces 3*c'* sandwich the terminals 9 and 9' therebetween. The first connector housing 1 is formed on an upper surface of the first connector housing 1 with a cantilever-type flexible lock arm 6 having a proximal end 6*a*. The lock arm 6 centrally includes an upwardly protruding protrusion 6*b*, and further includes a push-button portion 6*c* (see FIG. 25) at a free end thereof. When the lock arm 6 is compressed, the contact terminal 3 upwardly and downwardly resiliently moves.

In the conventional electric connector illustrated in FIGS. 24 and 25, the terminals 9 and 9' slide with the resilient pieces 3*c* and 3*c'* when the first and second connector housings 1 and 2 are coupled to each other, ensuring that even if the terminals 9 and 9' are contaminated or corroded, such contamination or corrosion can be removed or wiped by virtue of the frictional force generated by the slide movement of the terminals 9 and 9' relative to the resilient pieces 3*c* and 3*c'*. However, if a resistance against the slide movement of the terminals 9 and 9' relative to the resilient pieces 3*c* and 3*c'* were increased, the terminals 9 and 9' would be engaged with the resilient pieces 3*c* and 3*c'* when the lock arm 6 is inclining (see FIG. 25) before the lock arm 6 returns back to its original position (see FIG. 24), resulting in that the above-mentioned contamination or corrosion might be imperfectly wiped, and furthermore, the lock arm 6 might not be able to return back to its original position, resulting in that the first and second connector housings 1 and 2 are incompletely coupled to each other.

If the terminals 9 and the resilient pieces 3*c* and 3*c'* are electrically connected to each other, even if the first and second connector housings 1 and 2 are incompletely coupled to each other, it is difficult to find the first and second connector housings 1 and 2 incompletely coupled to each other. If the first and second connector housings 1 and 2 are pulled in a direction away from each other due to impact and/or oscillation when the first and second connector housings 1 and 2 are incompletely coupled to each other, the first and second connector housings 1 and 2 may be pulled out of each other. If so, since signal lines connected by the first and second connector housings 1 and 2 are cut, a safety unit cannot operate even in an emergency.

SUMMARY OF THE INVENTION

In view of the above-mentioned problem in the conventional electric connector, it is an object of the present invention to provide an electric connector which is capable of coupling to a second electric connector to thereby provide high reliability to electrical connection therebetween.

It is further an object of the present invention to provide a detection terminal to be included in the above-mentioned electric connector.

In one aspect of the present invention, there is provided an electric connector including a housing to be fit into a second electric connector, a lock arm resiliently deforming when the lock arm makes contact with an engagement part of the second electric connector, and thereafter, returning back to its original position, when the electric connector and the second electric connector are coupled to each other, a detection terminal for detecting whether the electric connector and the second electric connector are electrically connected to each other, and a unit for assisting the lock arm to return back to the original position, the lock arm, the detection terminal, and the unit being arranged in the housing, the detection terminal including a first portion to be fixed relative to the lock arm, and a second portion to make contact with a detection terminal of the second electric connector.

In the electric connector in accordance with the present invention, the lock arm is assisted by the unit to return back to its original position after having been resiliently deformed by the second electric connector, ensuring that the lock arm can surely return back to its original position, even if there are some causes preventing the lock arm from returning back to its original position. Thus, it is possible to engage the lock arm to the second electric connector.

It is preferable that the unit is formed, as a part of the detection terminal, integral with the first portion.

By designing the unit to be integral with the first portion, it is possible to form the detection terminal of a single thin metal plate having resiliency.

It is preferable that the unit has a free end which makes contact with a portion of the second electric connector when the housing and the second electric connector are coupled to each other, the unit exerting a reaction force onto the lock arm through the first portion fixed relative to the lock arm where the free end making contact with the portion acts as a fulcrum.

The unit starts assisting the lock arm to return back to its original position when the unit makes contact with a protrusion of the second electric connector, and hence, the lock arm can be slightly resiliently deformed before the lock arm is engaged with the second electric connector. The unit makes contact at a free end thereof with the protrusion. Since the unit assists the lock arm by using, as a fulcrum, the free end thereof making contact with the protrusion of the second electric connector, it is not necessary for the second electric connector to include a fulcrum for the lock arm.

It is preferable that the unit comprises a plate spring providing resilient force.

By designing the unit to comprise a plate spring, the unit can have an increased force for assisting the lock arm to return back to its original position.

It is preferable that the unit inclines relative to the first portion.

It is preferable that the unit is smaller in width at a position closer to a tip end thereof.

It is preferable that the unit is curved at a tip end thereof.

It is preferable that the detection terminal further includes a fourth portion connecting the first and second portions to each other, the fourth portion being resiliently deformable in accordance with a displacement of the second portion.

Even if the second portion displaces in accordance with the displacement of the detection terminal, the third portion is resiliently deformed to thereby absorb the displacement of the second portion, the second portion can follow the displacement of the detection terminal.

It is preferable that the second portion is substantially U-shaped, in which two extensions defining "U" are spaced from each other by a shorter distance and are smaller in width at a position closer to tip ends thereof.

For instance, the detection terminal may be made of a single metal sheet having resiliency.

In another aspect of the present invention, there is provided a detection terminal housed in one of a first electric connector and a second electric connector for detecting whether the first and second connectors are electrically connected to each other when the first and second electric connectors are coupled to each other, the first electric connector including a lock arm resiliently deforming when the lock arm makes contact with an engagement part of the second electric connector, and thereafter, returning back to its original position, when the first and second electric connectors are coupled to each other, the detection terminal including a first portion to be fixed relative to the lock arm, a second portion to make contact with a detection terminal of the second electric connector, and a third portion for assisting the lock arm to return back to the original position.

In the detection terminal in accordance with the present invention, it is preferable that the third portion extends from the first portion.

In the detection terminal in accordance with the present invention, it is preferable that the third portion has a free end which makes contact with a portion of the second electric connector when the first and second electric connectors are coupled to each other, the third portion exerting a reaction force onto the lock arm through the first portion fixed relative to the lock arm where the free end making contact with the portion acts as a fulcrum.

In the detection terminal in accordance with the present invention, it is preferable that the third portion comprises a plate spring providing resilient force.

In the detection terminal in accordance with the present invention, it is preferable that the third portion inclines relative to the first portion.

In the detection terminal in accordance with the present invention, it is preferable that the third portion is smaller in width at a position closer to a tip end thereof.

In the detection terminal in accordance with the present invention, it is preferable that the third portion is curved at a tip end thereof.

In the detection terminal in accordance with the present invention, it is preferable that the detection terminal further includes a fourth portion connecting the first and second portions to each other, the fourth portion being resiliently deformable in accordance with a displacement of the second portion.

In the detection terminal in accordance with the present invention, it is preferable that the second portion is substantially U-shaped, in which two extensions defining "U" are spaced from each other by a shorter distance and are smaller in width at a position closer to tip ends thereof.

In the detection terminal in accordance with the present invention, it is preferable that the detection terminal is made of a single metal sheet having resiliency.

The advantages obtained by the aforementioned present invention will be described hereinbelow.

In accordance with the present invention, the lock arm is assisted by the unit to return back to its original position after having been resiliently deformed by the second electric connector, ensuring that the lock arm can surely return back to its original position, even if there are some causes preventing the lock arm from returning back to its original position. Thus, it is possible to surely engage the lock arm to the second electric connector, ensuring high reliability in electrical connection between the electric connector and the second electric connector.

The above and other objects and advantageous features of the present invention will be made apparent from the following description made with reference to the accompanying drawings, in which like reference characters designate the same or similar parts throughout the drawings.

DESCRIPTION OF THE PREFERRED EMBODIMENTS

The electric connector in accordance with the preferred embodiment of the present invention is explained hereinbelow with reference to the drawings. In the specification, a "front" indicates a side of male and female electric connectors through which the male and female electric connectors are coupled to each other, and a "rear" indicates the opposite side to a "front".

Figure 1:
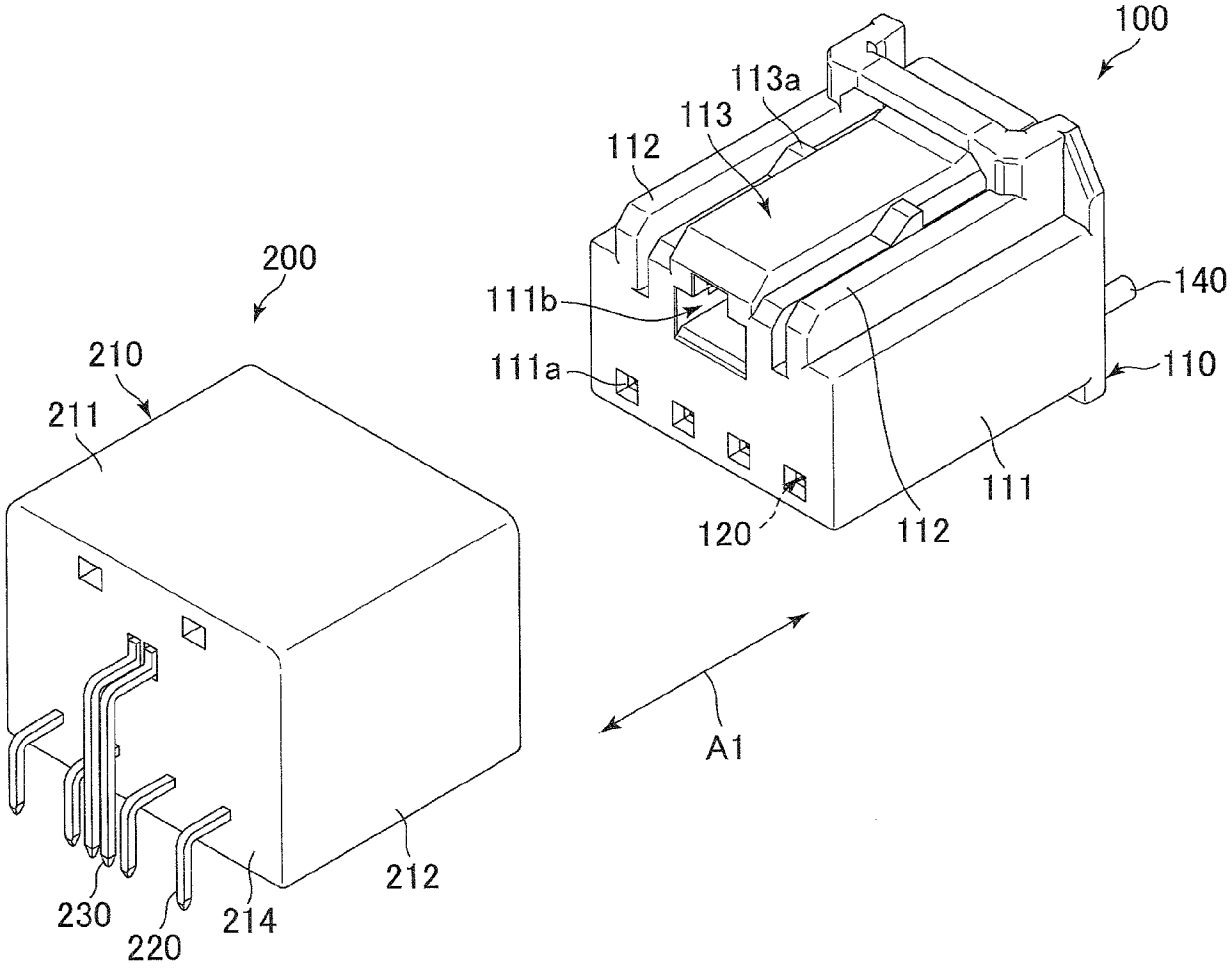
FIG. 1 is a perspective view of the electric connector in accordance with the preferred embodiment of the present invention, showing that the male and female electric connectors are separate from each other.

As illustrated in FIG. 1, the electric connector in accordance with the preferred embodiment of the present invention is embodied as a female electric connector 100. For instance, the female electric connector 100 in accordance with the current embodiment is employed together with a male electric connector 200 in a unit for operating an air bag equipped in an automobile. Specifically, the female and male electric connectors 100 and 200 are used to electrically connect wires used in the unit, to each other. Each of the female electric connector 100 and the male electric connector 200 is designed to include four contact terminals through which electrical signals are transmitted.

First, the female electric connector 100 is explained hereinbelow with reference to FIGS. 1 to 9.

Figure 2:
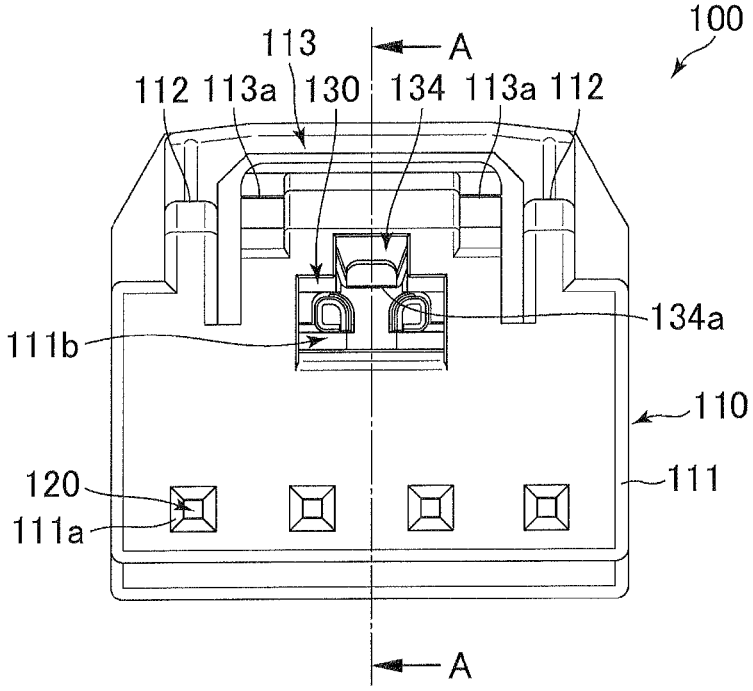
FIG. 2 is a front view of the female electric connector.
Figure 3:
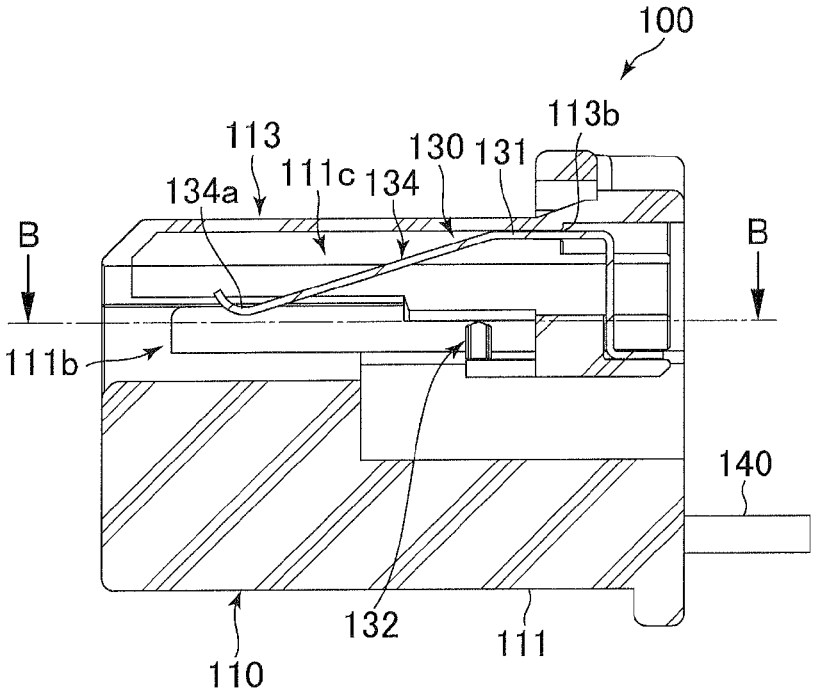
FIG. 3 is a cross-sectional view taken along the line A-A shown in FIG. 2.
Figure 4:
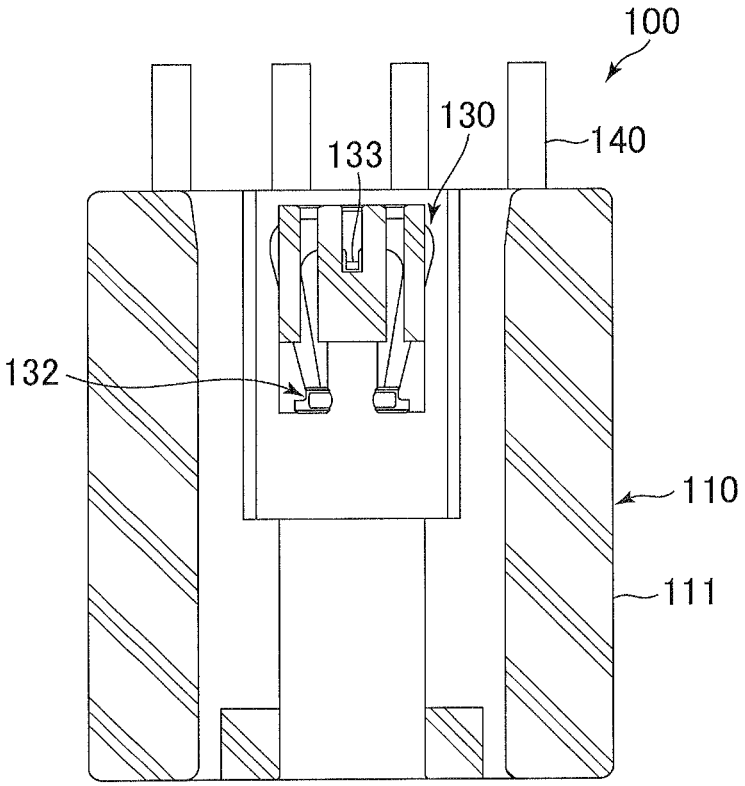
FIG. 4 is a cross-sectional view taken along the line B-B shown in FIG. 3.
Figure 5:
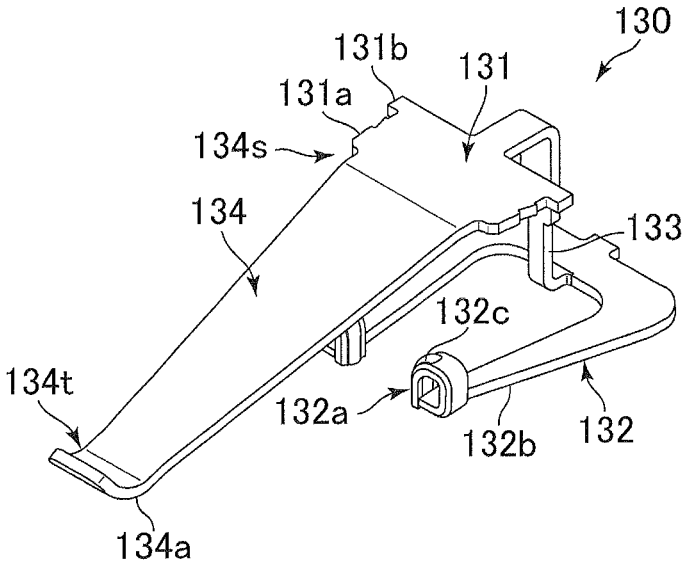
FIG. 5 is a perspective view of the detection terminal included in the female electric connector.

As illustrated in FIGS. 2 to 4, the female electric connector 100 includes a housing 110 fittable into the male electric connector 200, male contact terminals 120 making electrical contact with the male electric connector 200, and a first detection terminal 130 making electrical contact with a later-mentioned detection terminal of the male electric connector 200 to thereby detect whether the female electric connector 100 is electrically connected with the male electric connector 200.

Figure 10:
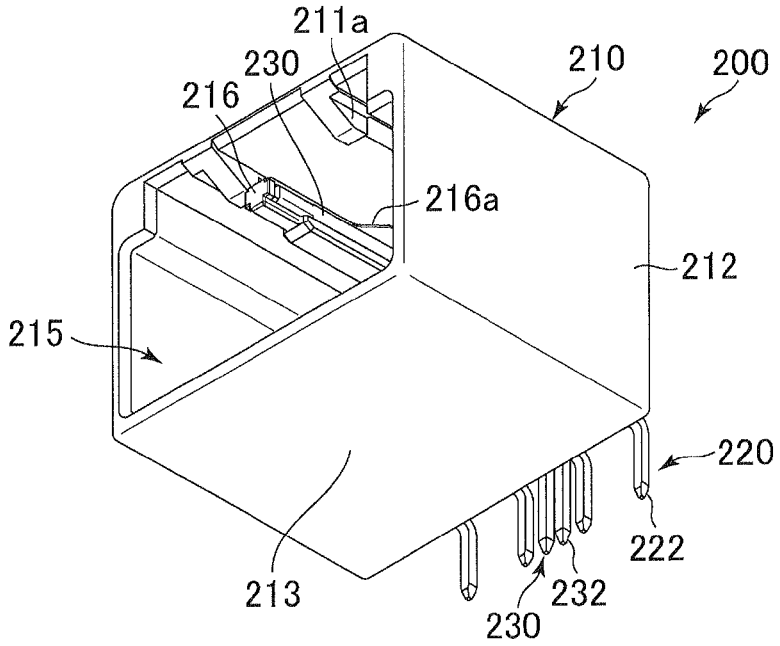
FIG. 10 is a lower perspective view of the male electric connector illustrated in FIG. 1.
Figure 11:
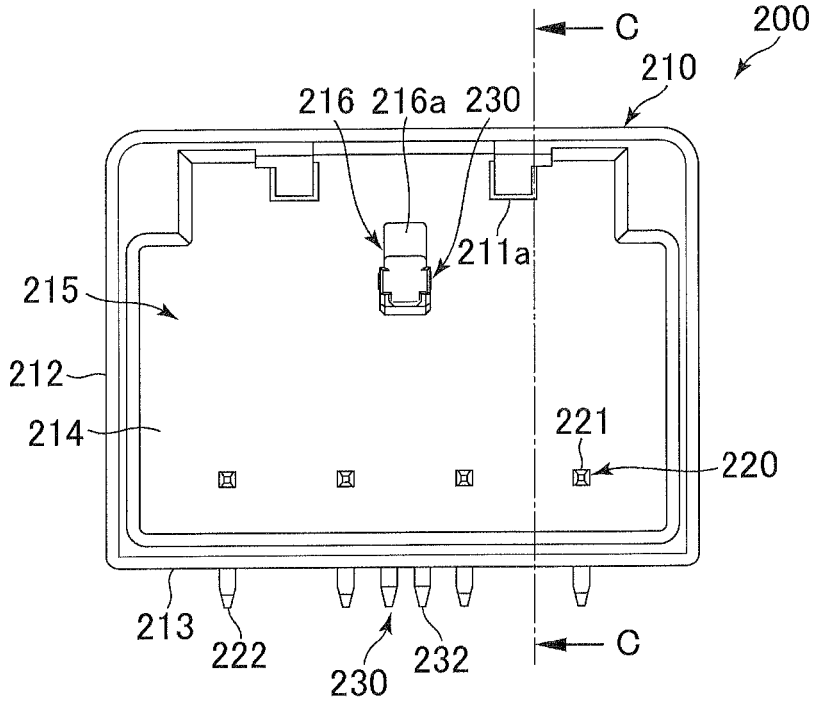
FIG. 11 is a front view of the male electric connector.
Figure 12:
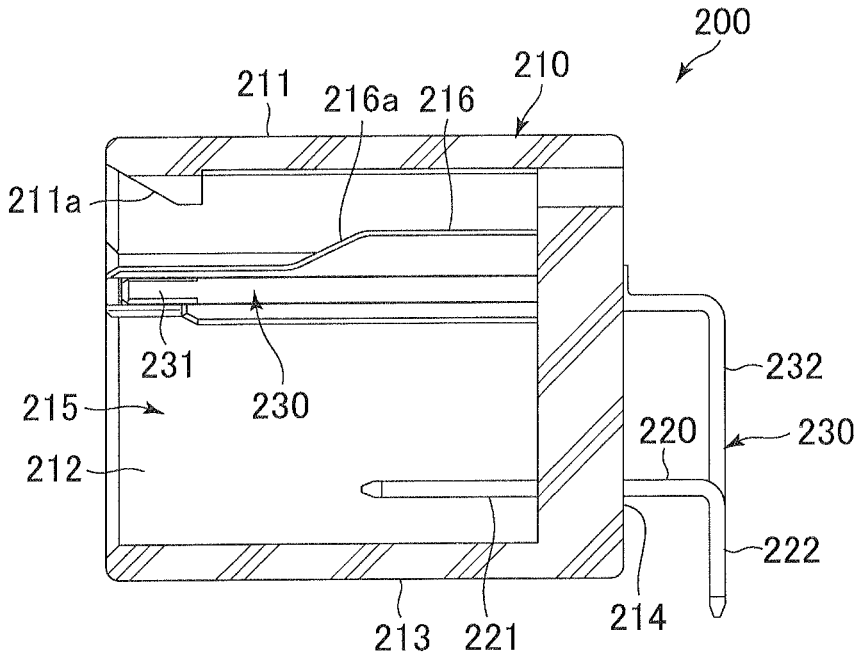
FIG. 12 is a cross-sectional view of the female electric connector, taken along the line C-C shown in FIG. 12.

The housing 110 comprises an outer housing to be fit into an inner space 10 (see FIG. 10) formed inside the male electric connector 200. The housing 110 is formed by mold injection, and includes a rectangular parallelepiped body 111, a pair of guides 112 formed on an upper surface of the body 111, and a lock arm 113 preventing the female electric connector 100 from being released from the male electric connector 200 after the female and male electric connectors 100 and 200 have been coupled to each other.

The body 111 is formed with four terminal spaces 111*a* arranged in a line in a width-wise direction of the body 111. Each of the female contact terminals 120 is housed in each of the terminal spaces 111*a*. The body 111 is formed at a front thereof with an opening 111*b* through which a later-mentioned terminal support is inserted into the body 111.

The guides 112 are situated such that the lock arm 113 is located therebetween, and extend from a front to a rear of the body in a direction A1 (see FIG. 1) in which the female and male electric connectors 100 and 200 are coupled to and separated from each other.

As illustrated in FIG. 3, the lock arm 113 has a front end through which the lock arm 113 is connected to the body 111, and a free rear end. The lock arm 113 is spaced away by a gap 111*c* from the body 111. Thus, the lock arm 113 is able to swing at the rear end thereof around the front end thereof. The lock arm 113 may be connected at the front end thereof to the body 111 through a plate spring. By forming the plate spring of a resin, the lock arm 113 can be formed integral with the body 111, ensuring that the lock arm 113 can have a reaction force at the rear end thereof.

The lock arm 113 includes resiliently deformable protrusions 113*a* (see FIG. 1). The protrusions 113*a* are caused to be downwardly deformed by the male electric connector 200 when the female electric connector 100 is coupled to the male electric connector 200, and thereafter, return back to their initial positions to thereby engage with the male electric connector 200. As illustrated in FIG. 3, the lock arm 113 is formed at a rear end thereof with a slot 113*b* in which the first detection terminal 130 is fixed.

Each of the female contact terminals 120 comprises a plate spring made from a thin metal sheet. The female contact terminals 120 sandwich a male contact terminal 220 (see FIG. 1) therebetween to thereby electrically connect the male contact terminal 220. Each of the female contact terminals 120 is connected at a rear end thereof to a cable 140 (see FIGS. 1 and 3) extending from the body 111.

As illustrated in FIGS. 5 to 8, the first detection terminal 130 can be fabricated by punching a metal sheet into a desired shape, and bending the punched metal sheet. The first detection terminal 130 includes a first portion 131 through which the first detection terminal 130 is fixed to the lock arm 113, a second portion 132 making electrical contact with a detection terminal of the male electric connector 200, a third portion 134 assisting the lock arm 113 to return back to its initial position, and a fourth portion 133 connecting the first and second portions 131 and 132 to each other.

Figure 7:
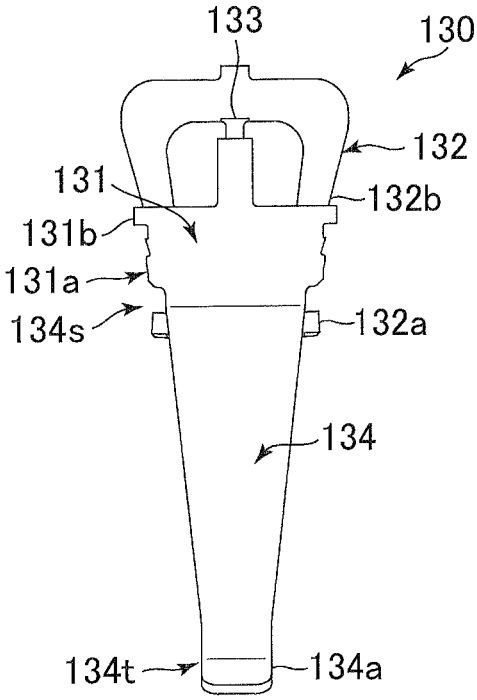
FIG. 7 is a plan view of the detection terminal illustrated in FIG. 5.
Figure 8:
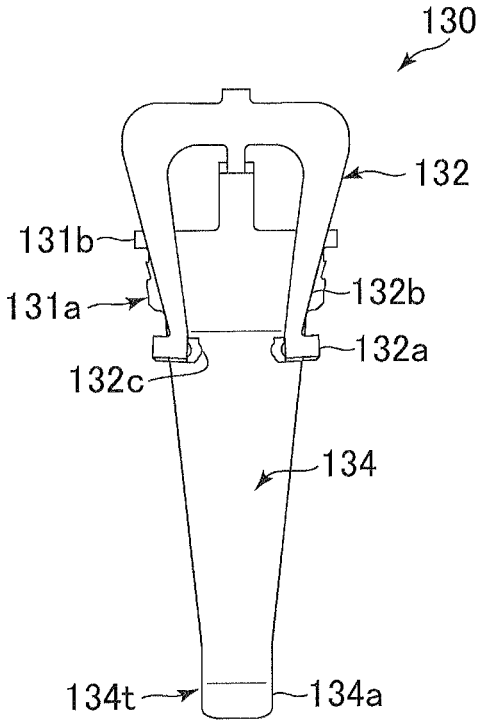
FIG. 8 is a bottom view of the detection terminal illustrated in FIG. 5.
Figure 9:
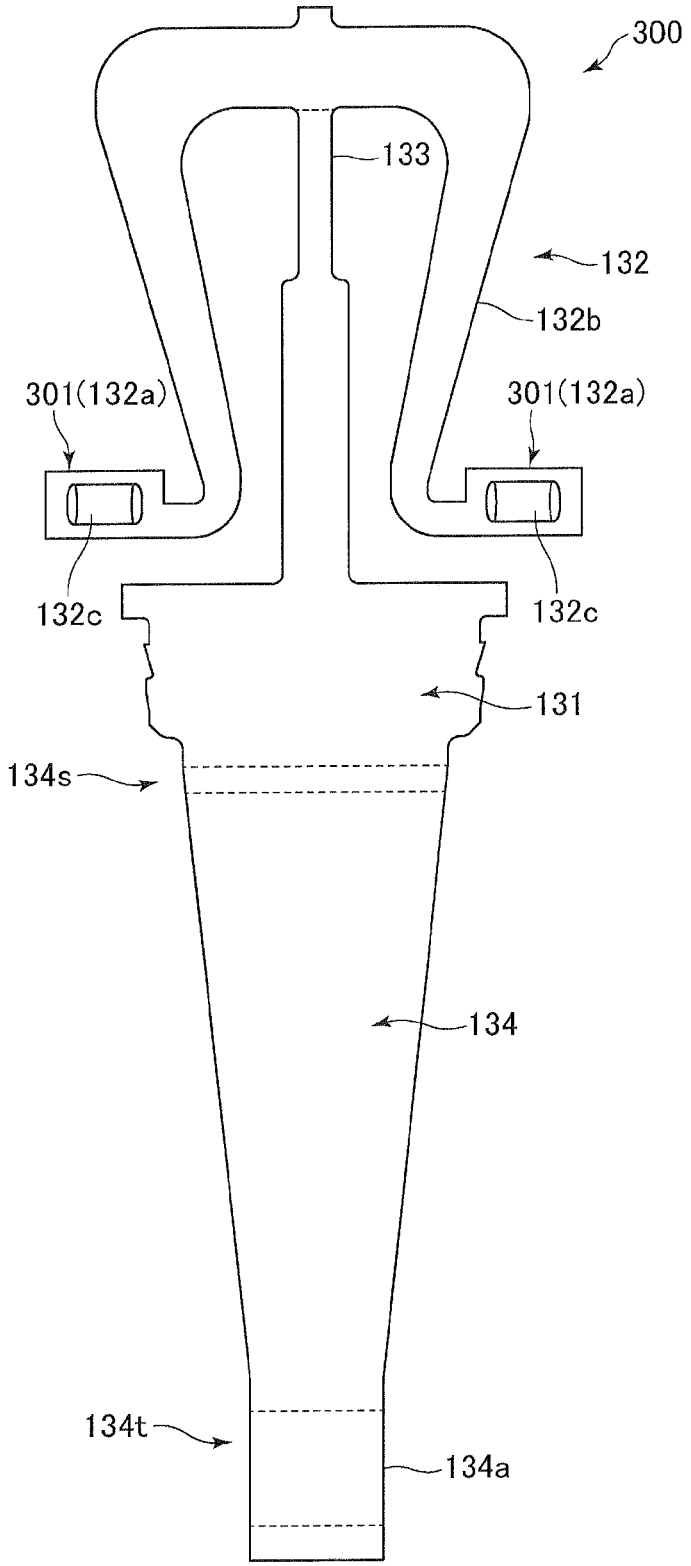
FIG. 9 illustrates a metal sheet from which the detection terminal illustrated in FIG. 5 is fabricated.

Since the first detection terminal 130 is fixed to the lock arm 113 and therefore to the housing 110 through the first portion 131, when the first detection terminal 130 is viewed from above, as illustrated in FIG. 7, the second portion 132 is able to swing in an arcuate orbit around the fourth portion 133.

The first portion 131 is inserted into the slot 113*b* to thereby be fixed in the lock arm 113. The first portion 131 includes a pair of projections 131*a*, and a pair of stoppers 131*b*.

The projections 131*a* extend at opposite sides of the first portion 131 in a width-wise direction of the first portion 131, and are stuck into inner walls of the slot 113*b* to thereby prevent the first detection terminal 130 from being released out of the lock arm 113.

The stoppers 113*b* make abutment with sidewalls of the slot 113*b* to thereby control a depth by which the first detection terminal 130 is inserted into the housing 110.

The second portion 132 includes a pair of contacts 132*a* each making mechanical and electrical contact with a detection terminal of the male electric connector 200, and a substantially U-shaped arm 132*b*.

The contacts 132*a* are reverse U-shaped, and are formed at tip ends of the arm 132*b*. Each of the contacts 132*a* has a contact surface 132*c* such that the contact surfaces 132*c* of the contacts 132*a* face each other. The contact surfaces 132*c* stand perpendicularly to the arm 132*b*. The contact surfaces 132*c* are beaded to thereby be arcuate, projecting towards each other, for ensuring sufficient contact with a detection terminal of the male electric connector 200.

The arm 132*b* is made of a metal sheet, and acts as a spring. The arm 132*b* has two extensions defining "U" spaced from each other by a shorter distance and smaller in width at a position closer to the tip ends of the arm 132*b* in order to resiliently deform to sandwich therebetween a detection terminal of the male electric connector 200. The arm 132*b* is situated substantially in parallel with a detection terminal of the male electric connector 200 when the female and male electric connectors 100 and 200 are coupled to each other.

Figure 6:
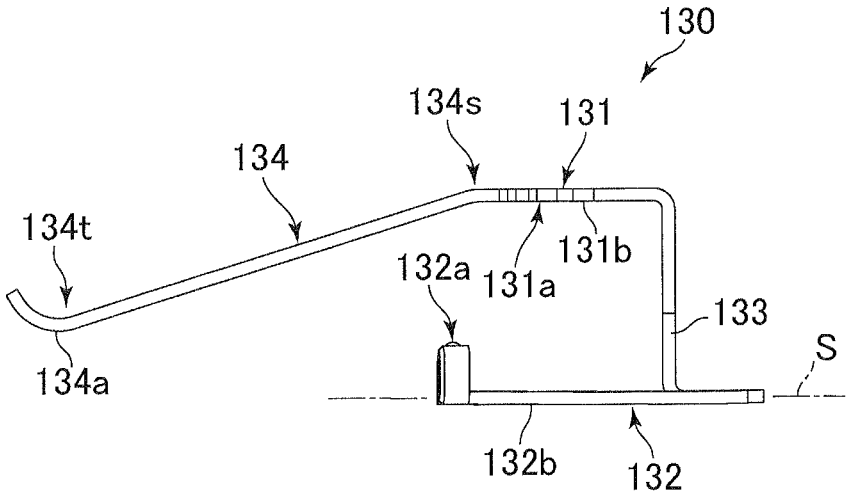
FIG. 6 is a side view of the detection terminal illustrated in FIG. 5.

The fourth portion 133 is in the form of a bar, and is resiliently deformable in accordance with a displacement of the second portion 132. The fourth portion 133 is connected at one end thereof with a proximal end of the arm 132. As illustrated in FIG. 6, the fourth portion 133 stands from an imaginary plane S including the arm 132 therein, and is connected at the other end thereof with the first portion 131. Specifically, the fourth portion 133 vertically extends to connect the first portion 131 extensive above and in parallel with the imaginary plane S, to a proximal end of the arm 132*b*. Furthermore, both the fourth portion 133 and the first portion 131 are located at a center of the two extensions defining "U" of the arm 132*b*, when viewed above from the arm 132*b*. The first portion 131 extends in the same direction as a direction in which the arm 132*b* extends.

The third portion 134 is continuous at a proximal end 134*s* thereof to the first portion 131 to act as a plate spring. The third portion 134 downwardly inclines relative to the first portion 131 from the proximal end 134*s* to a tip end 134*t* thereof.

The third portion 134 is designed to be smaller in width at a position closer to the tip end 134*s* thereof. The third portion 134 is upwardly curved at the tip end 134*t* thereof to thereby define an arcuate slide contact portion 134*a*. Since the third portion 134 extends into the opening 111*b* through the gap 111*c*, the gap 111*c* and the opening 111*b* are continuous to each other without being separated by a partition wall.

The process of fabricating the first detection terminal 130 having the structure as mentioned above is explained hereinbelow.

First, there is prepared a single thin metal sheet having resiliency.

Then, the metal sheet is beaded at an area where the contact surfaces 132*c* are to be formed, to thereby form arcuate walls. Then, the metal sheet is punched into a metal sheet 300 having a shape illustrated in FIG. 9.

The contact surfaces 132*a* are formed by upwardly raising metal pieces 301 extending from tip ends of the arm 132*b* in a direction away from each other, and bending the metal pieces 301 into a reverse "U" such that the metal pieces 301 define an inner space therein.

The slide contact portion 134*a* is formed by upwardly curving the tip end 134*t* of the third portion 134. Furthermore, the third portion 134 is caused to incline downwardly, that is, in a direction opposite to a direction in which the metal pieces 301 are raised, around the proximal end 134*s* of the third portion 134 (a boundary between the first portion 131 and the third portion 134).

The first portion 131 is bent in a direction opposite to a direction in which the metal pieces 301 are raised, and further, downwardly by 90 degrees relative to the fourth portion 133. The fourth portion 133 is bent in a direction opposite to a direction in which the first portion 131 is bent, and further, upwardly by 90 degrees relative to the arm 132*b*. Thus, the fourth portion 133 and the first portion 131 are bent in an L-shape relative to each other. That is, the first portion 131 extends perpendicularly to the fourth portion 133, and the fourth portion 133 stands relative to the arm 132*b*. Thus, there is completed the first detection terminal 130.

The male electric connector 200 is explained hereinbelow with reference to FIGS. 1 and 10 to 12.

The male electric connector 200 includes a housing 210 fittable into the housing 111 of the female electric connector 100, contact terminals 220 to electrically connect with the female electric connector 100, and a pair of second detection terminals 230 to make mechanical and electrical contact with the first detection terminal 130 of the female electric connector 100 to thereby detect whether the female and male electric connectors 100 and 200 are electrically connected to each other.

The housing 210 is in the form of a box, and is made by resin molding. The housing 210 is defined by a ceiling 211, sidewalls 212 facing each other, a bottom 213, and a rear wall 214. The housing 210 is formed therein with an inner space 215.

The ceiling 211 is formed on an inner surface thereof with a pair of engagement projections 211*a*.

A terminal support 216 straightly extends from an inner surface of the rear wall 214 towards an opening of the inner space 215.

The second detection terminals 230 are formed on opposite sidewalls of the terminal support 216. The terminal support 216 is formed on an upper surface thereof with a tapered surface 216*a* upwardly inclining from an opening of the inner space 215 towards the rear wall 214. Herein, the upper surface of the terminal support 216 indicates a surface on which the third portion 133 of the detection terminal makes contact at the slide contact portion 134*a* therewith when the female and male electric connectors 100 and 200 are coupled to each other.

The engagement projections 211*a* are situated at an opening of the inner space 215 such that they can be engaged with the protrusions 113*a* (see FIG. 1) of the lock arm 113.

The four male contact terminals 220 are arranged in a line in the inner space 215 in a width-wise direction of the housing 210 in correspondence to the female contact terminals 120 illustrated in FIG. 2. Each of the male contact terminals 220 includes a needle contact 221 extending in the inner space 215 from the rear wall 214, and a reverse L-shaped terminal 222 extending outwardly of the housing 210 from the rear wall 214. Each of the second detection terminals 230 is made of an elongate thin metal piece extending at opposite sidewalls of the support terminal 216 in the direction A1 (see FIG. 1) from a leading edge to a trailing edge of the support terminal 216. The second detection terminal 230 includes a contact 231 (see FIG. 12) at a tip end thereof, and a reverse L-shaped pin terminal 232 extending through the rear wall 214.

Hereinbelow are explained how the female electric connector 100 in accordance with the embodiment is coupled to the male electric connector 200, and how the female electric connector 100 is used.

Figure 13:
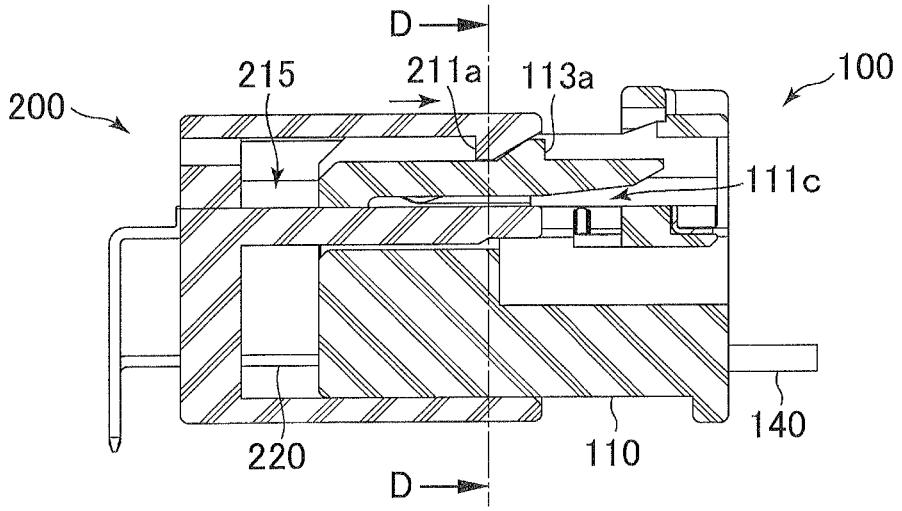
FIG. 13 is a cross-sectional view of the male and female electric connectors.
Figure 14:
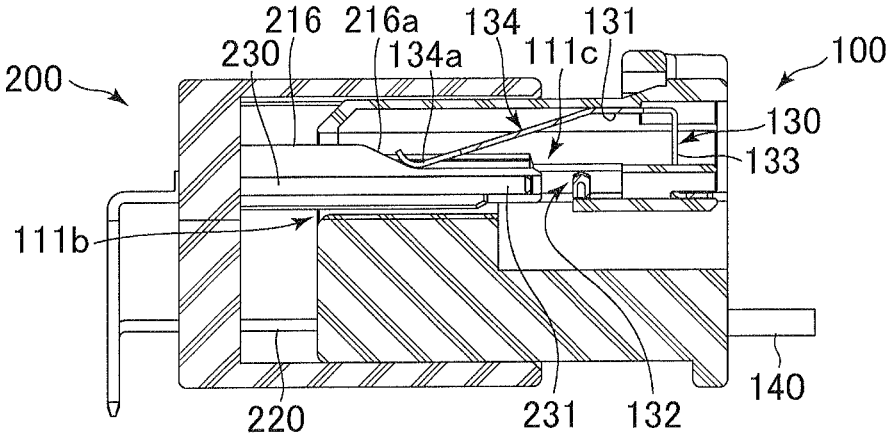
FIG. 14 is a cross-sectional view of the male and female electric connectors, taken along the line C-C shown in FIG. 11.
Figure 15:
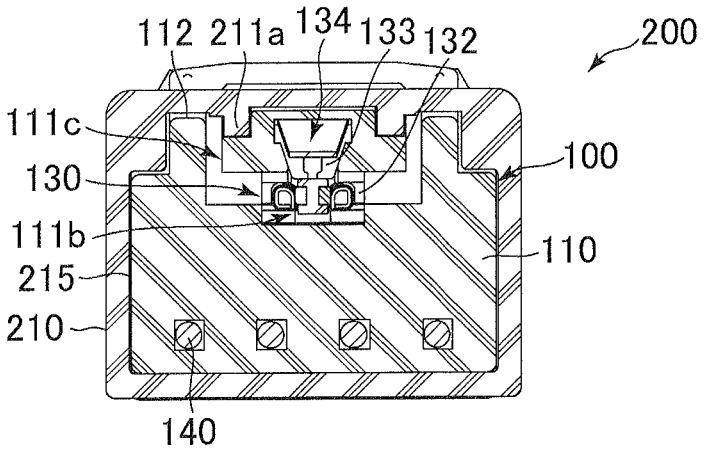
FIG. 15 is a cross-sectional view of the male and female electric connectors, taken along the line D-D shown in FIG. 13.

First, the female electric connector 100 is forwarded through a front thereof into the inner space 215 of the male electric connector 200. As illustrated in FIGS. 13 to 15, forwarding the female electric connector 100 in the inner space 215 of the male electric connector 200, the terminal support 216 is inserted into the opening 111*b* of the female electric housing 110, and is forwarded towards the first detection terminal 130.

Since the guides 112 (see FIG. 1) of the housing 110 forward into the housing 210 along an inner wall of the inner space 215, the housing 110 can be straightly inserted into the inner space 215. While the housing 110 is being inserted into the inner space 215, the third portion 134 of the first detection terminal 130 makes contact at the slide contact portion 134*a* thereof with an upper surface of the terminal support 216, and slides on the terminal support 216 keeping the slide contact portion 134*a* to be in contact with the upper surface of the terminal support 216. The engagement projections 211*a* of the male electric connector 100 make abutment at tapered fronts thereof with tapered fronts of the protrusions 113*a* of the lock arm 113, and then, the male contact terminals 200 start making contact with the female contact terminals 120 (see FIG. 2).

Figure 16:
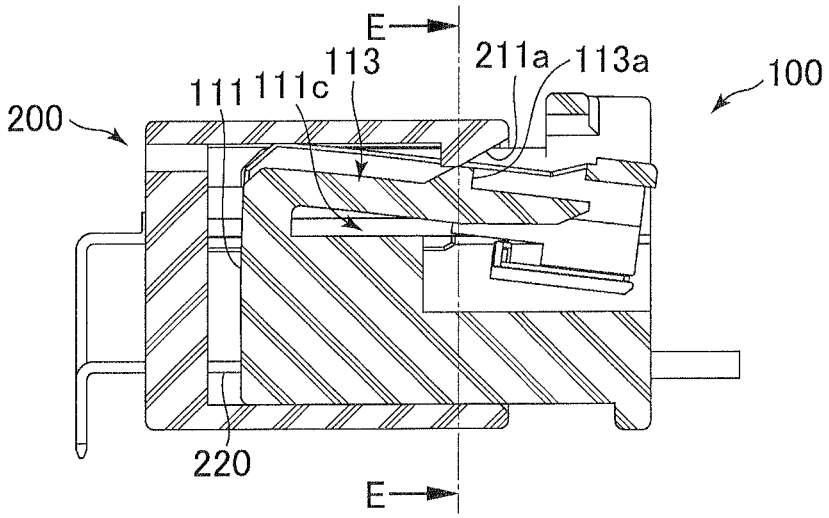
FIG. 16 is a cross-sectional view of the male and female electric connectors.
Figure 17:
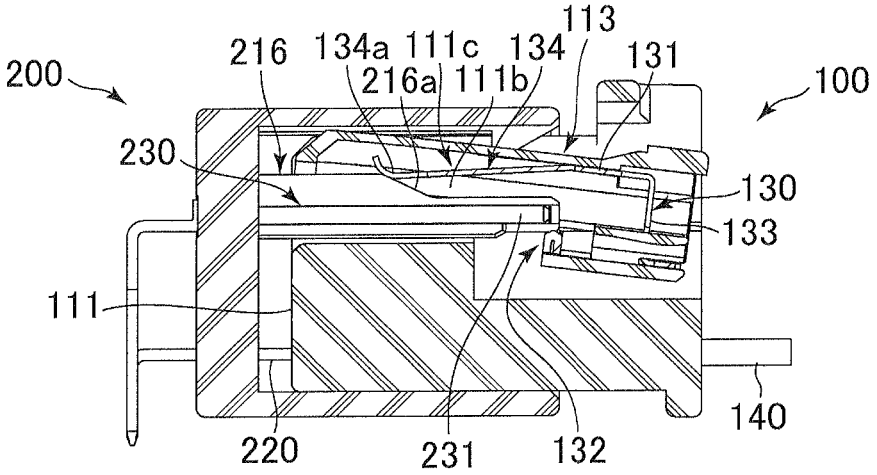
FIG. 17 is a cross-sectional view of the male and female electric connectors, taken along the line C-C shown in FIG. 11.
Figure 18:
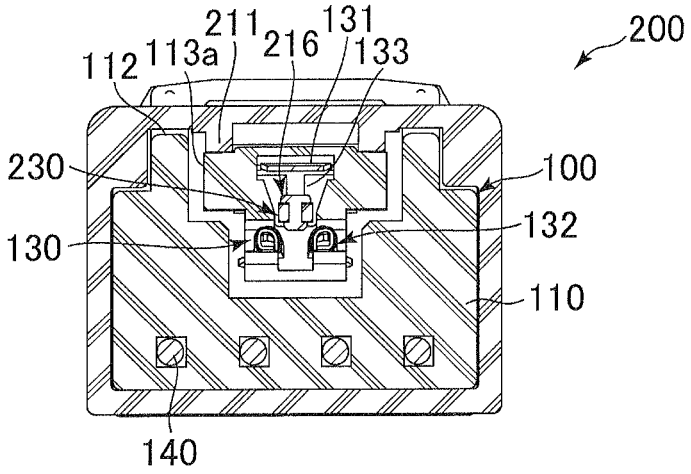
FIG. 18 is a cross-sectional view of the male and female electric connectors, taken along the line E-E shown in FIG. 16.

By forwarding the housing 110 of the female electric connector 100 after the engagement projections 211*a* have made abutment at the tapered fronts thereof with the tapered fronts of the protrusions 113*a*, as illustrated in FIGS. 16 to 18, the protrusions 113*a* are pushed downwardly by the tapered fronts of the engagement projections 211*a*, and accordingly, the lock arm 113 is pushed downwardly towards the gap 111*c*. Since the lock arm 113 is connected at a front end thereof with the body 111, and is free at a rear end thereof, the front end of the lock arm 113 exerts an upwardly directed reaction force on the rear end of the lock arm 113, and the lock arm 113 is caused to sink at the rear end thereof with the front end thereof acting as a fulcrum, as illustrated in FIG. 17. Furthermore, since the tapered surface 216*a* of the terminal support 216 is situated below the slide contact portion 134*a* of the third portion 134, the third portion 134 is pushed upwardly by the tapered surface 216*a*, and thus, the third portion 134 starts assisting the lock arm 113 to return back to its initial position. Herein, the initial position of the lock arm 113 indicates a position illustrated in FIG. 13. At the present stage, since the lock arm 113 is pushed downwardly towards the gap 111*c* as a result that the engagement projections 211*a* make abutment with the protrusions 113*a*, the first detection terminal 130 is accordingly located below the contact 231 of the second detection terminal 230.

Figure 19:
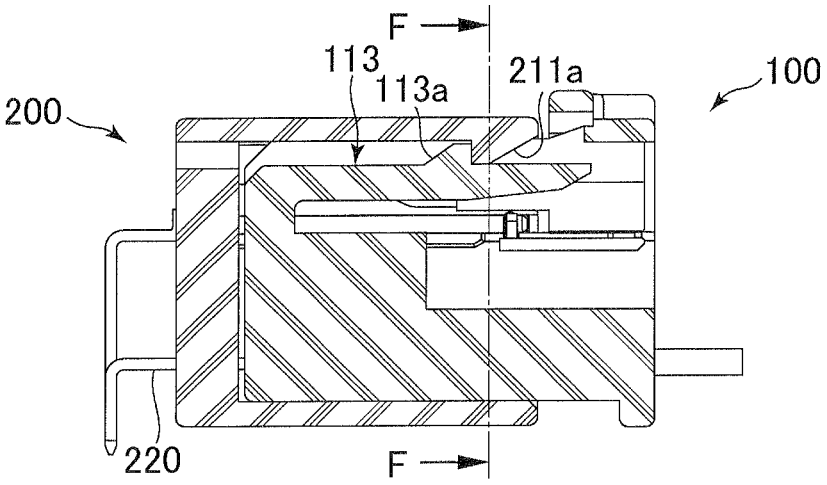
FIG. 19 is a cross-sectional view of the male and female electric connectors.
Figure 20:
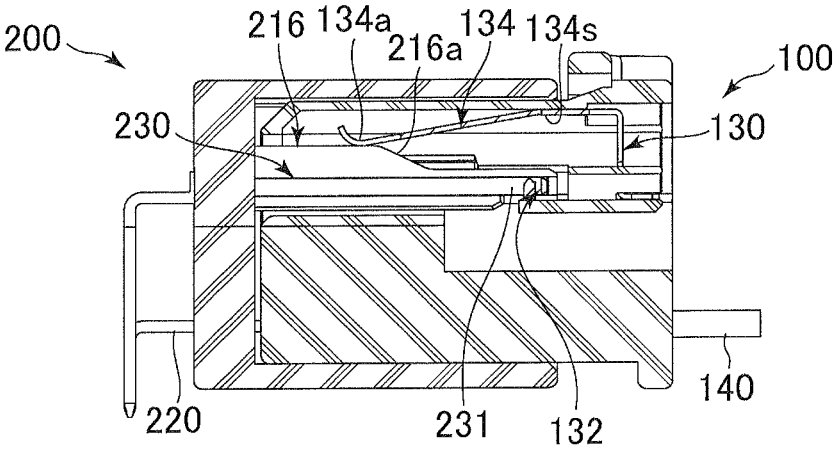
FIG. 20 is a cross-sectional view of the male and female electric connectors, taken along the line C-C shown in FIG. 11.
Figure 21:
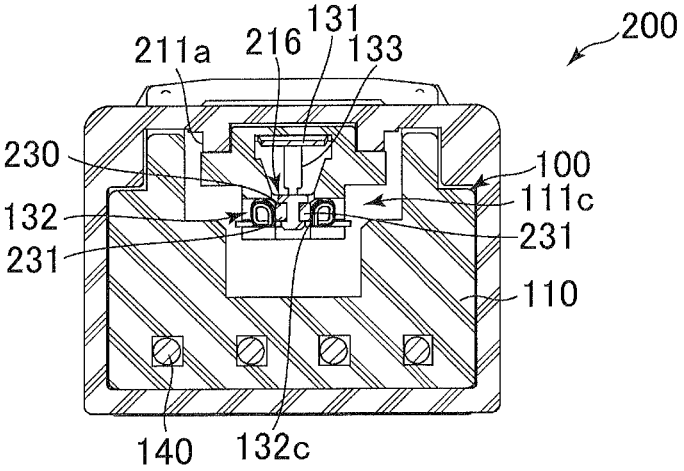
FIG. 21 is a cross-sectional view of the male and female electric connectors, taken along the line F-F shown in FIG. 21.

Then, as illustrated in FIGS. 19 to 21, when the engagement projections 211*a* pass over the protrusions 113*a*, the lock arm 113 resiliently returns back to its initial position, the engagement projections 211*a* and the protrusions 113*a* face each other at rear surfaces of them and are engaged to each other. The engagement between the engagement projections 211*a* and the protrusions 113*a* prevents the female electric connector 100 from being released out of the male electric connector 200. As a result that the lock arm 113 has resiliently returned back to its original position, the first detection terminal 130 fixed relative to the lock arm 113 also moves upwardly, and thus, the second portion 132 of the first detection terminal 130 makes contact with the contact 231 of the second detection terminal 230 arranged on the terminal support 216.

While the second portion 132 is making contact with the contact 231, the contact surfaces 132*c* (see FIG. 21) of the first detection terminal 130 and the contacts 231 of the second detection terminal 230 are wiped by each other.

Since the detection terminal 131 is fixed to the lock arm 113 through the first portion 131, the contact surfaces 132*c* of the first detection terminal 130 slide with the contacts 231 of the second detection terminal 230 when the lock arm 113 swings around the front end thereof. Thus, even if the contact surfaces 132*c* and/or the contacts 231 were contaminated and/or corroded, the contamination and/or the corrosion can be wiped away by virtue of the frictional force generated by the slide movement between the contact surfaces 132*c* and the contacts 231, ensuring enhancement in reliability to electrical connection between the first detection terminal 130 and the second detection terminal 230.

Figure 22:
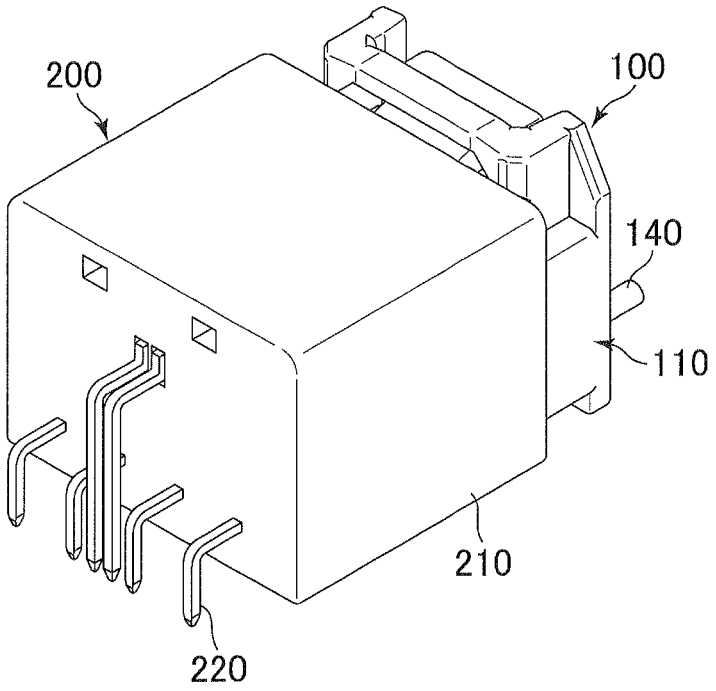
FIG. 22 is a perspective view of the male and female electric connectors coupled to each other.

The male contact terminals 220 and the female contact terminals 120 make contact with each other in the above-mentioned process, as illustrated in FIG. 22.

As illustrated in FIG. 20, when the lock arm 113 resiliently returns back to its initial position, the rear end of the lock arm 113 moves upwardly relative to a position where the rear end of the lock arm 113 sank. Since the slide contact portion 134*a* of the third portion 134 slides on the tapered surface 216*a*, the slide contact portion 134*a* simultaneously moves upwardly. Thus, a gap between an upper surface of the terminal support 216 and the proximal end 134*s* of the third portion 134 is reduced, and hence, the third portion 134 can provide an increased resilient force. Hence, even after the lock arm 113 had returned back to its initial position, the third portion 134 upwardly pushes the first portion 131 with the slide contact portion 134*a* acting as a fulcrum.

Accordingly, even if the lock arm 113 were difficult to return back to its initial position by the fact that a resistance with which the second portion 132 and the contacts 231 of the second detection terminal 230 slide with each other is increased, or that the lock arm 113 provides a reduced resilient reaction force at the front end thereof, the third portion 134 upwardly pushes the lock arm 113 to thereby assist the lock arm 113 to return back to its initial position.

As explained so far, since the female electric connector 100 in accordance with the preferred embodiment is designed to include the third portion 134 for assisting the lock arm 113 to return back to its initial position, the lock arm 112 can be assisted by the third portion 134 of the first detection terminal 130 to thereby be able to surely return back to its initial position. Thus, the female electric connector 100 to be coupled to the male electric connector 200 can provide high reliability to electrical connection therebetween.

Since the third portion 134 is formed integral with the first portion 131 as a part of the first detection terminal 130, the first detection terminal 130 can be made of a single thin metal plate having resiliency.

When the female electric connector 100 is coupled to the male electric connector 200, the third portion 134 makes contact at the slide contact portion 134*t* thereof with the support terminal 216 on which the second detection terminal 230 is equipped, and pushes upwardly the lock arm 113 through the proximal end 134*s* thereof.

For instance, a fulcrum at which the third portion 134 assists the lock arm 113 to return back to its initial position may be formed within the body 111 of the housing 110, in which case, it is necessary to fix the third portion 134 onto, for instance, a partition wall formed between the gap 111*c* necessary for the lock arm 113 to swing, and the opening 111*b* into which the terminal support 216 is inserted. In this situation, the lock arm 113 keeps being pushed by the third portion 134.

The third portion 134 starts assisting the lock arm 113 to return back to its initial position when the third portion 134 makes contact with the terminal support 216 entering the housing 110, that is, when the female electric connector 100 is coupled to the female electric connector 200. Thus, before the lock arm 113 is engaged with the housing 210 of the male electric connector 100, the lock arm 113 may be resiliently slightly deformed.

Furthermore, since the third portion 134 makes contact at the slide contact portion 134*a* formed at the tip end 134*t* thereof, with the terminal support 216 of the male electric connector 200, it is not necessary for the male electric connector 200 to include a partition wall and so on to fix the tip end 134*t* of the third portion 134 thereto. Thus, the body 111 of the female electric connector 110 can be designed to have a simple structure.

Hereinbelow is explained a case in which the female electric connector 100 or the male electric connector 200 swings horizontally or vertically in dependence on a gap formed between the housing 110 and the inner space 215 of the housing 210.

If one of the male and female electric connectors 100 and 200 displaces vertically relatively to each other, that is, in a direction perpendicular to the imaginary plane S in which the arm 132*b* exists, the second detection terminal 230 also displaces in the same direction.

Since the contacts 132*a* of the first detection terminal 130 sandwiching the second detection terminal 230 therebetween is designed to have the contact surface 132*c* extending perpendicularly to the arm 132*b*, even if the second detection terminal 230 vertically displaces, the contact surfaces 132*c* can be kept in contact with the contact 231 of the second detection terminal 230.

Figure 23:
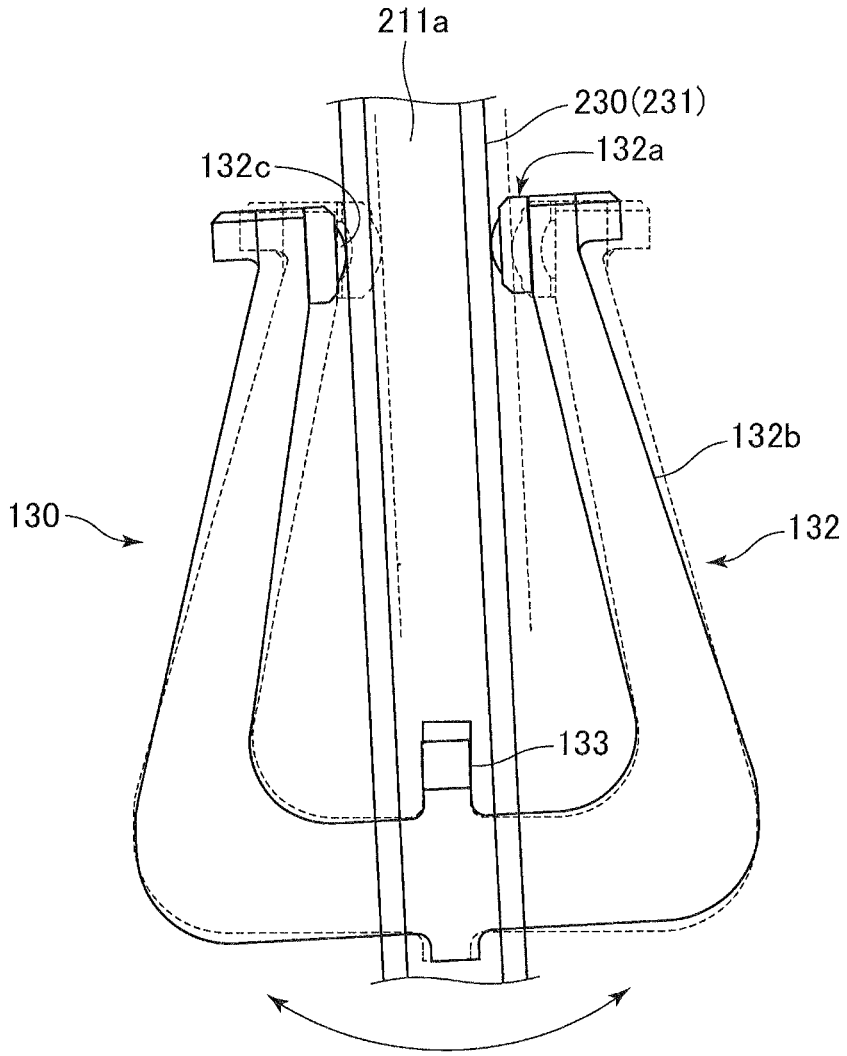
FIG. 23 is a plan view of the resiliently deformed detection terminal.
Figure 24:
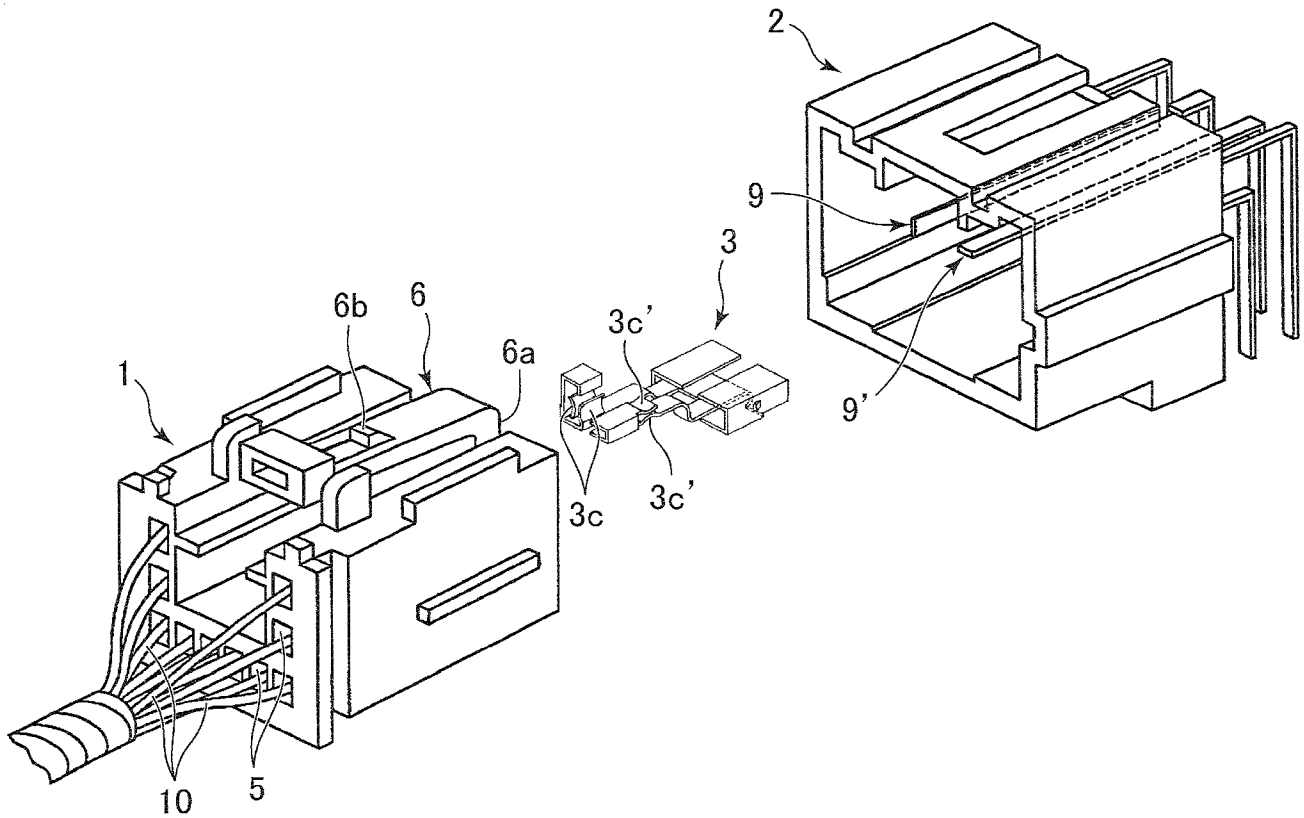
FIG.24 PRIOR ART
FIG. 24 is a perspective view of the conventional male and female electric connectors.
Figure 25:
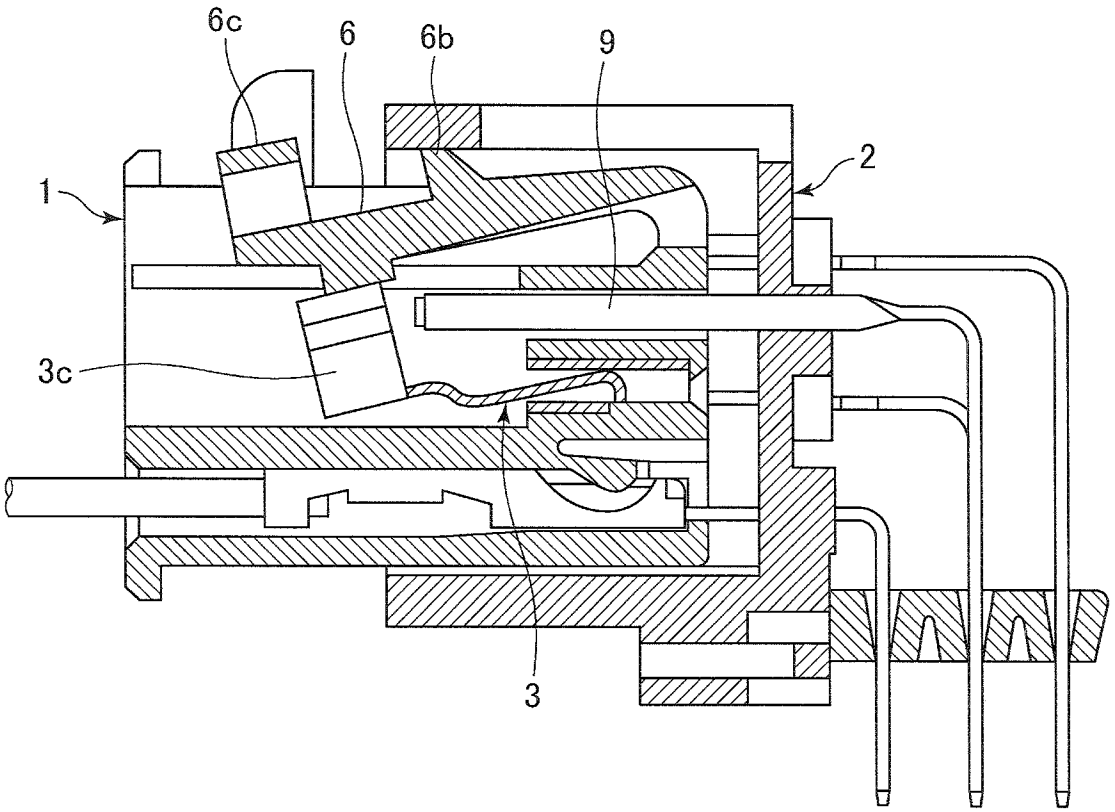
FIG.25 PRIOR ART
FIG. 25 is a cross-sectional view of the conventional male and female electric connectors illustrated in FIG. 24.

If one of the male and female electric connectors 100 and 200 displaces horizontally relatively to each other, that is, in a direction in which the imaginary plane S is extensive, the second detection terminal 230 displaces in the same direction, and inclines relative to the first detection terminal 130 (see FIG. 23).

As illustrated in FIG. 21, the first portion 131 of the first detection terminal 130 is fixed to the lock arm 113 formed at the housing 110, and the arm 132*b* (see FIG. 5) of the second portion 132 sandwiches the second detection terminal 230 therebetween by virtue of the resiliency thereof. Thus, as illustrated in FIG. 23, even if the fourth portion 133 is twisted in any direction, the second portion 132 keeps its position, that is, keeps sandwiching the second detection terminal 230 therebetween without being resiliently deformed. Accordingly, the contacts 132*a* are able to keep in contact with the second detection terminal 230 without reducing a contact pressure therebetween. Thus, the first detection terminal 130 can keep a contact pressure with which the first detection terminal 130 makes contact with the second detection terminal 230, ensuring enhancement in reliability to the electrical contact therebetween. For simplification, the first portion 131 and the third portion 134 both of the first detection terminal 130 are not illustrated in FIG. 23.

Since the fourth portion 133 is connected to the proximal end of the arm 132*b*, even if the second detection terminal 230 with which a pair of the contacts 132*a* makes contact displaces to a much degree, a degree by which the fourth portion 133 is resiliently deformed can be reduced by virtue of a length of the arm 132*b*. Accordingly, it is not necessary to design the fourth portion 133 to be able to be resistive against resilient deformation, the fourth portion 133 can be made of a thin metal sheet.

Since a pair of the contacts 132*a* sandwiches the second detection terminal 230 at outer surfaces of the second detection terminal 230, the arm 132*b* can swing as if a neck shakes, if the second detection terminal 230 displaces between the contacts 132*a*. Thus, the second detection terminal 230 can displace to an increased degree.

In addition, since the fourth portion 133 is made of a plate connected at one end thereof with the second portion 132 and at the other end with the first portion 131, the fourth portion 133 can be readily resiliently deformed, ensuring that the second portion 132 can follow the displacement of the second detection terminal 230.

INDUSTRIAL APPLICABILITY

The present invention is suitable to an electric connector employed broadly in a field such as an automobile industry, an electric/electronic device industry, and various machine industries, as a device for connecting wires through which electric signals are transmitted, to each other.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

The entire disclosure of Japanese Patent Application No. 2013-0237344 filed on Nov. 15, 2013 including specification, claims, drawings and summary is incorporated herein by reference in its entirety.

What is claimed is:

1. An electric connector including:

a housing to be fit into a second electric connector;

a lock arm resiliently deforming when said lock arm makes contact with an engagement part of said second electric connector, and thereafter, returning back to its original position, when said electric connector and said second electric connector are coupled to each other;

a first detection terminal for detecting whether said electric connector and said second electric connector are electrically connected to each other; and a unit for assisting said lock arm to return back to said original position, said lock arm, said first detection terminal, and said unit being arranged in said housing, said first detection terminal including a first portion to be fixed relative to said lock arm, and a second portion to make contact with a second detection terminal of said second electric connector, said unit being formed, as a part of said first detection terminal, integral with said first portion, said unit having a free end which makes contact with a portion of said second electric connector when said housing and said second electric connector are coupled to each other, said unit exerting a reaction force onto said lock arm through said first portion fixed relative to said lock arm where said free end making contact with said portion acts as a fulcrum, said second electric connector being formed therein with a slope ascending towards a proximal end thereof from an opening end thereof, said unit making contact with said slope when said electric connector is fit into said second electric connector.

2. The electric connector as set forth in claim 1, wherein said unit comprises a plate spring providing resilient force.

3. The electric connector as set forth in claim 1, wherein said unit inclines relative to said first portion.

4. The electric connector as set forth in claim 1, wherein said unit is smaller in width at a position closer to a tip end thereof.

5. The electric connector as set forth in claim 1, wherein said unit is curved at a tip end thereof.

6. The electric connector as set forth in claim 1, wherein said first detection terminal further includes a fourth portion connecting said first and second portions to each other, said fourth portion being resiliently deformable in accordance with a displacement of said second portion.

7. The electric connector as set forth in claim 1, wherein said second portion is substantially U-shaped, in which two extensions defining "U" are spaced from each other by a shorter distance and are smaller in width at a position closer to tip ends thereof.

8. The electric connector as set forth in claim 1, wherein said first detection terminal is made of a single metal sheet having resiliency.

9. A first detection terminal housed in one of a first electric connector and a second electric connector for detecting whether said first and second connectors are electrically connected to each other when said first and second electric connectors are coupled to each other, said first electric connector including a lock arm resiliently deforming when said lock arm makes contact with an engagement part of said second electric connector, and thereafter, returning back to its original position, when said first and second electric connectors are coupled to each other, said first detection terminal including:

a first portion to be fixed relative to said lock arm;

a second portion to make contact with a second detection terminal of said second electric connector; and a third portion for assisting said lock arm to return back to said original position, said third portion extending from said first portion, said third portion having a free end which makes contact with a portion of said second electric connector when said first and second electric connectors are coupled to each other, said third portion exerting a reaction force onto said lock arm through said first portion fixed relative to said lock arm where said free end making contact with said portion acts as a fulcrum, said second electric connector being formed therein with a slope ascending towards a proximal end thereof from an opening end thereof, said third portion making contact with said slope when said electric connector is fit into said second electric connector.

10. The first detection terminal as set forth in claim 9, wherein said third portion comprises a plate spring providing resilient force.

11. The first detection terminal as set forth in claim 9, wherein said third portion inclines relative to said first portion.

12. The first detection terminal as set forth in claim 9, wherein said third portion is smaller in width at a position closer to a tip end thereof.

13. The first detection terminal as set forth in claim 9, wherein said third portion is curved at a tip end thereof.

14. The first detection terminal as set forth in claim 9, wherein said first detection terminal further includes a fourth portion connecting said first and second portions to each other, said fourth portion being resiliently deformable in accordance with a displacement of said second portion.

15. The first detection terminal as set forth in claim 9, wherein said second portion is substantially U-shaped, in which two extensions defining "U" are spaced from each other by a shorter distance and are smaller in width at a position closer to tip ends thereof.

16. The first detection terminal as set forth in claim 9, wherein said first detection terminal is made of a single metal sheet having resiliency.

* * * * *